US006515462B2

(12) United States Patent
Inoue et al.

(10) Patent No.: US 6,515,462 B2
(45) Date of Patent: Feb. 4, 2003

(54) POWER SUPPLY DEVICE

(75) Inventors: Koichi Inoue, Kyoto (JP); Hirokazu Oki, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 72 days.

(21) Appl. No.: 09/779,709

(22) Filed: Feb. 9, 2001

(65) Prior Publication Data

US 2001/0017489 A1 Aug. 30, 2001

(30) Foreign Application Priority Data

Feb. 10, 2000 (JP) ..... 2000-038153

(51) Int. Cl.[7] ..... G05F 3/16; G05F 5/00
(52) U.S. Cl. ..... 323/315; 323/303; 323/274
(58) Field of Search ..... 323/312, 313, 323/314, 315, 316, 274, 280, 281, 282, 284, 285, 303

(56) References Cited

U.S. PATENT DOCUMENTS 4,556,838 A * 12/1985 Brasseur ..... 323/285
4,792,747 A * 12/1988 Schroeder ..... 323/303

* cited by examiner

*Primary Examiner*—Jessica Han
(74) *Attorney, Agent, or Firm*—Arent Fox Kinter Plotkin and Kahn

(57) ABSTRACT

A power supply device produces a predetermined voltage from a supply voltage through a voltage follower composed of a plurality of transistors. The voltage follower has a function of preventing backflow current. The voltage follower has one end connected to the supply voltage and another end connected to a capacitor. A constant voltage generating circuit produces a constant voltage from the voltage across the capacitor. A switch circuit is connected between the supply voltage and the control electrode of one of the transistors constituting the voltage follower other than the first-stage transistor thereof. A voltage drop detecting circuit detects a drop below a predetermined level in the voltage across the capacitor, and turns on the switch circuit on detecting such a drop.

6 Claims, 4 Drawing Sheets

POWER SUPPLY DEVICE

BACKGROUND OF THE INVENTION

1. Field of the Invention

The present invention relates to a power supply device for supplying electric power from a power source to a load.

2. Description of the Prior Art

A conventional example of the circuit configuration of a power supply device designed for use in car-mounted audio equipment or the like is shown in FIG. 4. As shown in this figure, in this circuit, to obtain high current capacity, and to prevent backflow current from a smoothing capacitor C to a battery, the supply voltage $V_{CC}$ from the battery is fed out through a voltage follower 101 composed of two NPN-type transistors 111 and 112 that are connected to form a Darlington pair and a diode D connected in a forward direction between the collector of the transistor 112 and the supply voltage $V_{CC}$. A resistor 114 is connected to the base of the transistor 111.

A constant voltage generating circuit 102 operates on the voltage $V_{CC}'$ output from the voltage follower 101 to produce a constant voltage. The voltage $V_{OUT}$ output from the constant voltage generating circuit 102 is fed, for example, to a microcomputer provided in car-mounted audio or video equipment (not shown) as its operating voltage.

In a car, when the engine is started, or when the audio equipment or the like is switched on, a sharp, instantaneous drop is very likely in the supply voltage supplied from the car battery. On the other hand, on the part of a load, an instantaneous drop in the operating voltage supplied thereto that goes beyond the tolerable range may cause, for example, unintended resetting of a microcomputer. Hereinafter, intended operation will be referred to as "normal operation."

The conventional power supply device configured as described above produces an output voltage that is lower than the supply voltage by as much as $n \times V_F$, where n represents the number of transistors constituting the voltage follower 101 and $V_F$ represents the voltage drop between the base and emitter of each transistor. Therefore, in the event of an instantaneous drop in the supply voltage as mentioned above, this power supply device causes a sharper drop in the operating voltage supplied to a load. Thus, this power supply device demands that the supply voltage be kept within a comparatively narrow range to ensure normal operation of the load. From a different perspective, this requires that a load be designed specially to operate normally on a lower minimum operating voltage, for example by designing its microcomputer to be reset at a lower voltage, and thus leads to higher costs.

SUMMARY OF THE INVENTION

An object of the present invention is to provide a power supply device that tolerates a wider range for a drop in a supply voltage to ensure normal operation of a load.

To achieve the above object, according to one aspect of the present invention, a power supply device that produces a predetermined voltage from a supply voltage through a voltage follower composed of a plurality of transistors is provided with: a switch circuit connected between the supply voltage and the control electrode of one of the transistors constituting the voltage follower other than the first-stage transistor thereof; and a voltage drop detecting circuit for turning on the switch circuit when a level of the supply voltage is lower than a threshold level.

In this circuit configuration, if it is assumed that the switch circuit is connected to the control electrode of the k-th stage transistor, as counted from the input side, among the transistors that are Darlington-connected to form the voltage follower, the difference in voltage by which the voltage on the output side of the voltage follower is lower than the supply voltage is $n \times V_F$ (where n represents the number of transistors that are Darlington-connected to form the voltage follower) when the switch circuit is off, but, when the switch circuit is turned on, this difference in voltage reduces to $(n-k+1) \times V_F$ equivalent to the sum of the voltage drops across part of the transistors and across the switch circuit itself. Thus, by appropriately setting the threshold level, it is possible to secure high current capacity as long as no drop is detected in the voltage supplied from the power supply device to a load, and, even if a drop in the supply voltage causes a drop in the voltage supplied from the power supply device to the load, it is possible to minimize the drop.

According to another aspect of the present invention, a power supply device that produces a predetermined voltage from a supply voltage through a voltage follower composed of a transistor is provided with: a switch circuit connected between the supply voltage and the output side of the voltage follower; and a voltage drop detecting circuit for turning on the switch circuit when a level of the supply voltage is lower than a threshold level.

In this circuit configuration, the difference in voltage by which the voltage on the output side of the voltage follower is lower than the supply voltage is $n \times V_F$ when the switch circuit is off, but, when the switch circuit is turned on, this difference in voltage reduces to a value equivalent to the voltage drop across the switch circuit alone. Thus, by appropriately setting the threshold level, it is possible to secure high current capacity as long as no drop is detected in the voltage supplied from the power supply device to a load, and, even if a drop in the supply voltage causes a drop in the voltage supplied from the power supply device to the load, it is possible to minimize the drop.

As the switch circuit mentioned above, it is possible to use, for example, the output-side transistor of a current mirror circuit. The threshold voltage mentioned above is, for example in cases where a constant voltage generating circuit is additionally provided that operates on the output voltage from the voltage follower to produce a constant voltage, set equal to the level of the supply voltage at which the output voltage from the constant voltage generating circuit starts falling.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
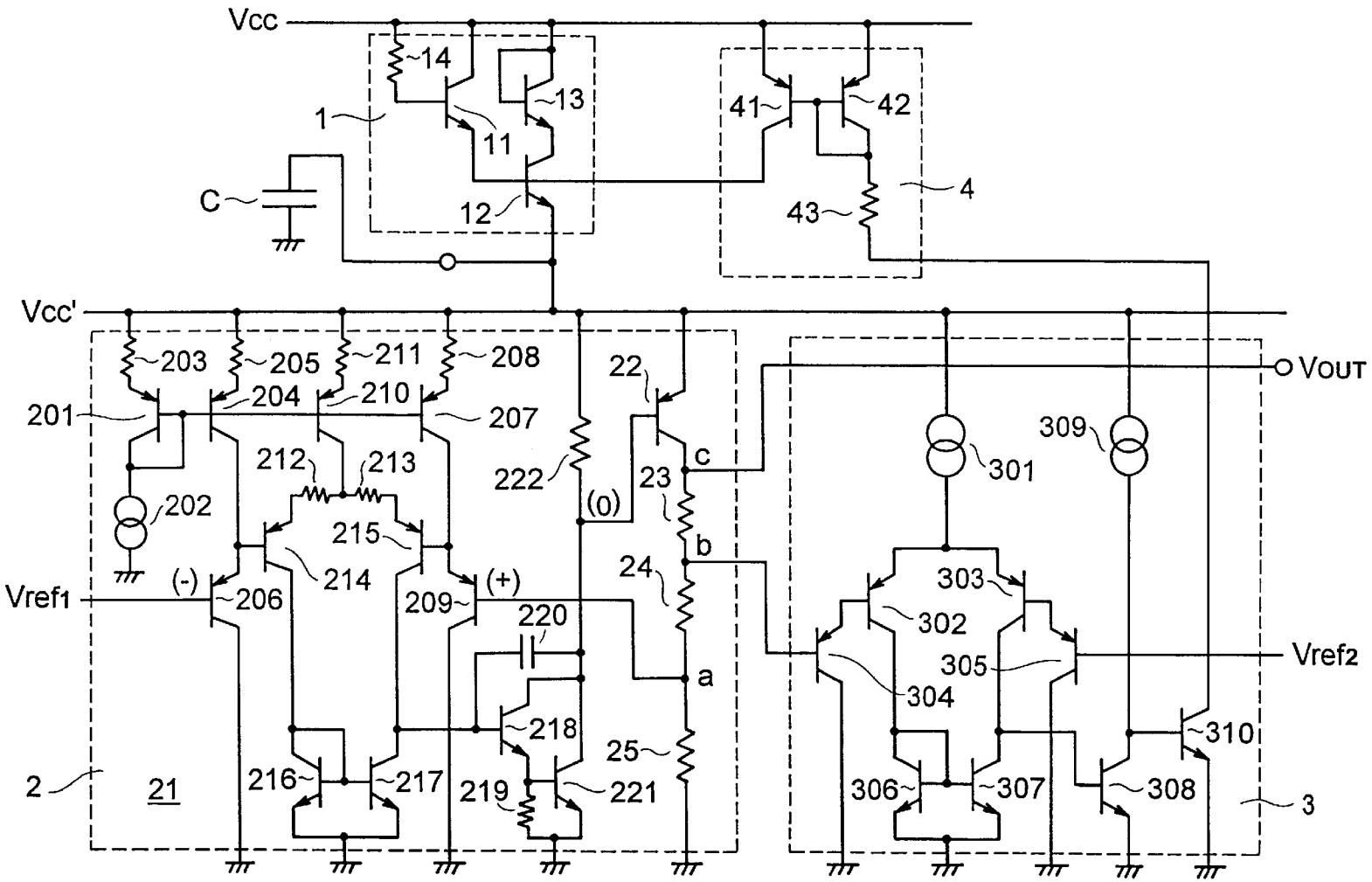
FIG. 1 is a circuit diagram of the power supply device of a first embodiment of the invention.

Hereinafter, embodiments of the present invention will be described with reference to the drawings. FIG. 1 shows a circuit diagram of the power supply device, designed for car-mounted use, of a first embodiment of the invention. This power supply device of the first embodiment is composed of a voltage follower 1, a constant voltage generating circuit 2, a voltage drop detecting circuit 3, and a switch circuit 4. These circuits are formed as an IC (integrated circuit) on a single chip.

First, the circuit configuration of the voltage follower 1 will be described. Two NPN-type transistors 11 and 12 are connected to form a Darlington pair. Of these Darlington-connected transistors 11 and 12, the first-stage transistor 11 receives at its base a supply voltage $V_{CC}$ from a battery through a resistor 14, and receives at its collector the supply voltage $V_{CC}$ directly.

Of the two Darlington-connected transistors 11 and 12, the last-stage transistor 12 has its collector connected to the emitter of a transistor 13 that is diode-connected. This transistor 13 receives at its collector and base the supply voltage $V_{CC}$. The output side of the voltage follower 1 (i.e. the emitter of the transistor 12) is grounded through a smoothing capacitor C, which is fitted externally. The voltage $V_{CC}'$ output from the voltage follower 1 is supplied to the constant voltage generating circuit 2, to the voltage drop detecting circuit 3, and to other circuits as their operating voltage.

Next, the circuit configuration of the constant voltage generating circuit 2 will be described. A reference voltage $V_{ref1}$ is applied to an inverting input terminal (−) of an operational amplifier 21. The output terminal (O) of the operational amplifier 21 is connected to the base of a PNP-type transistor 22. This transistor 22 receives at its emitter the voltage $V_{CC}'$. The collector of the transistor 22 is connected to ground through three resistors 23, 24, and 25 that are connected in series.

The non-inverting input terminal (+) of the operational amplifier 21 is connected to the node "a" between the resistors 24 and 25. The constant voltage generating circuit 2 outputs the voltage $V_{OUT}$ appearing at the node "c" between the collector of the transistor 22 and the resistor 23. The voltage $V_{OUT}$ thus output from the constant voltage generating circuit 2 is fed, for example, to a microcomputer or the like as its operating voltage.

Next, the circuit configuration of the operational amplifier 21 will be described. A PNP-type transistor 201 is diode-connected, receives at its emitter the voltage $V_{CC}'$ through a resistor 203, and outputs at its collector a constant current to a constant current source 202. The other end of the constant current source 202 is connected to ground.

A PNP-type transistor 204 has its base connected to the base of the transistor 201, receives at its emitter the voltage $V_{CC}'$ through a resistor 205, and has its collector connected to the emitter of a PNP-type transistor 206. The collector of the transistor 206 is connected to ground.

A PNP-type transistor 207 has its base connected to the base of the transistor 201, receives at its emitter the voltage $V_{CC}'$ through a resistor 208, and has its collector connected to the emitter of a PNP-type transistor 209. The collector of the transistor 209 is connected to ground.

A PNP-type transistor 210 has its base connected to the base of the transistor 201, receives at its emitter the voltage $V_{CC}'$ through a resistor 211, and has its collector connected to the emitters of PNP-type transistors 214 and 215 through resistors 212 and 213, respectively. The bases of the transistors 214 and 215 are connected to the emitters of the transistors 206 and 209, respectively.

An NPN-type transistor 216 is diode-connected, has its collector connected to the collector of the transistor 214, and has its emitter grounded. An NPN-type transistor 217 has its base connected to the base of the transistor 216, has its emitter grounded, and has its collector connected to the collector of the transistor 215.

An NPN-type transistor 218 has its base connected to the node between the collectors of the transistors 215 and 217, and has its emitter grounded through a resistor 219. Between the base and collector of the transistor 218, a capacitor 220 is connected for phase compensation.

An NPN-type transistor 221 has its base connected to the node between the transistor 218 and the resistor 219, and has its emitter grounded. The transistors 218 and 221 receive at their collectors the voltage $V_{CC}'$ through a resistor 222 that is common to them.

The bases of the transistors 209 and 206 serve as the non-inverting input terminal (+) and the inverting input terminal (−), respectively, of the operational amplifier 21, and the node at which the transistors 218 and 221 and the resistor 222 are connected together serves as the output terminal (O) of the operational amplifier 21.

Configured as described above, the constant voltage generating circuit 2 is automatically controlled in such a way that its output voltage $V_{OUT}$ is kept at a predetermined level (more specifically, in such a way that the voltage at the node "a" between the resistors 24 and 25 is kept equal to the reference voltage $V_{ref1}$) unless the supply voltage $V_{CC}$ becomes so low as to saturate the transistor 22.

Next, the circuit configuration of the voltage drop detecting circuit 3 will be described. To the output side of a constant current source 301, the emitters of PNP-type transistors 302 and 303 are connected together. The base of the transistor 302 is connected to the emitter of a PNP-type transistor 304. The collector of the transistor 302 is connected to the collector of an NPN-type transistor 306 that is diode-connected. The base of the transistor 304 is connected to the node "b" between the resistors 23 and 24 of the constant voltage generating circuit 2. The collector of the transistor 304 is grounded.

The base of the transistor 303 is connected to the emitter of a PNP-type transistor 305. The collector of the transistor 303 is connected to the collector of an NPN-type transistor 307. A reference voltage $V_{ref2}$ is applied to the base of the transistor 305. The collector of the transistor 305 is grounded.

The transistors 306 and 307 have their bases connected together so as to form a current mirror circuit with the transistor 306 serving as the input-side transistor and the transistor 307 serving as the output-side transistor. The transistors 306 and 307 have their emitters grounded.

An NPN-type transistor 308 has its base connected to the node between the transistors 303 and 307. The emitter of the transistor 308 is grounded. The transistor 308 receives at its collector a constant current output from a constant current source 309, of which the other end is connected to the voltage $V_{CC}'$.

An NPN-type transistor 310 has its base connected to the collector of the transistor 308. The emitter of the transistor 310 is grounded. The collector of the transistor 310 is connected through a resistor 43 to the collector of the input-side transistor 42 of a current mirror circuit that constitutes the switch circuit 4 described below.

Next, the circuit configuration of the switch circuit 4 will be described. A PNP-type transistor 42 is diode-connected, and has its base connected to the base of a PNP-type transistor 41 SO that these two transistors 41 and 42 together constitute a current mirror circuit.

The input-side transistor 42 receives at its emitter the supply voltage $V_{CC}$, and has its collector connected through the resistor 43 to the collector of the transistor 310 of the voltage drop detecting circuit 3. The output-side transistor 41 receives at its emitter the supply voltage $V_{CC}$, and has its collector connected to the base of the transistor 12 of the voltage follower 1.

Configured as described above, the power supply device of this embodiment operates as described below. As long as the output voltage $V_{OUT}$ from the constant voltage generating circuit 2 is kept at the predetermined level, the voltage at the node "b" is higher than the reference voltage $V_{ref2}$. Hence, the current flowing through the transistor 303 becomes higher than the current flowing through the transistor 302, and thus the transistor 308 turns on. As a result, the transistor 310 of the voltage drop detecting circuit 3 is off, and thus the output-side transistor 41 of the current mirror circuit constituting the switch circuit 4 is off. Consequently, the transistors 11 and 12 of the voltage follower 1 operate so as to offer high current capacity.

By contrast, when the supply voltage $V_{CC}$ becomes so low that the voltage at the node "b" in the constant voltage generating circuit 2 becomes lower than the reference voltage $V_{ref2}$, in other words, when the output voltage $V_{OUT}$ from the constant voltage generating circuit 2 becomes lower than the predetermined level, in the voltage drop detecting circuit 3, the current flowing through the transistor 303 becomes lower than the current flowing through the transistor 302, and thus the transistor 308 turns off. As a result, the transistor 310 turns from off to on, and thus the transistor 42 of the current mirror circuit constituting the switch circuit 4 turns from off to on. This causes a current to be supplied from the supply voltage $V_{CC}$ through the output-side transistor 41 of the current mirror circuit constituting the switch circuit 4 to the base of the transistor 12 of the voltage follower 1. Here, let the collector-emitter voltage of the transistor 41 in its saturated state be $V_{SAT}$, then the output voltage $V_{OUT}$ of the constant voltage generating circuit 2 is given by $V_{CC}-V_{SAT}-V_F$ (as compared with $V_{CC}-2\times V_F$ obtained conventionally). More specifically, since $V_F\approx 0.7$ [V] and $V_{SAT}\approx 0.1$ [V], the voltage $V_{OUT}$ output from the constant voltage generating circuit 2 is equal to $V_{CC}-0.8$ [V] here as compared with $V_{CC}-1.4$ [V] obtained conventionally. In this way, it is possible to reduce the drop that appears in the voltage $V_{OUT}$ as a result of a drop in the supply voltage $V_{CC}$.

In the first embodiment described above, the number of transistors that are Darlington-connected in the voltage follower 1 may be three or more. In that case, as the current capacity required is higher, the switch circuit 4 is connected to the base of the transistor in a stage closer to the input side. It is possible to omit the constant voltage generating circuit 2 and use instead the voltage $V_{CC}'$ as the operating voltage of other circuits.

Figure 2:
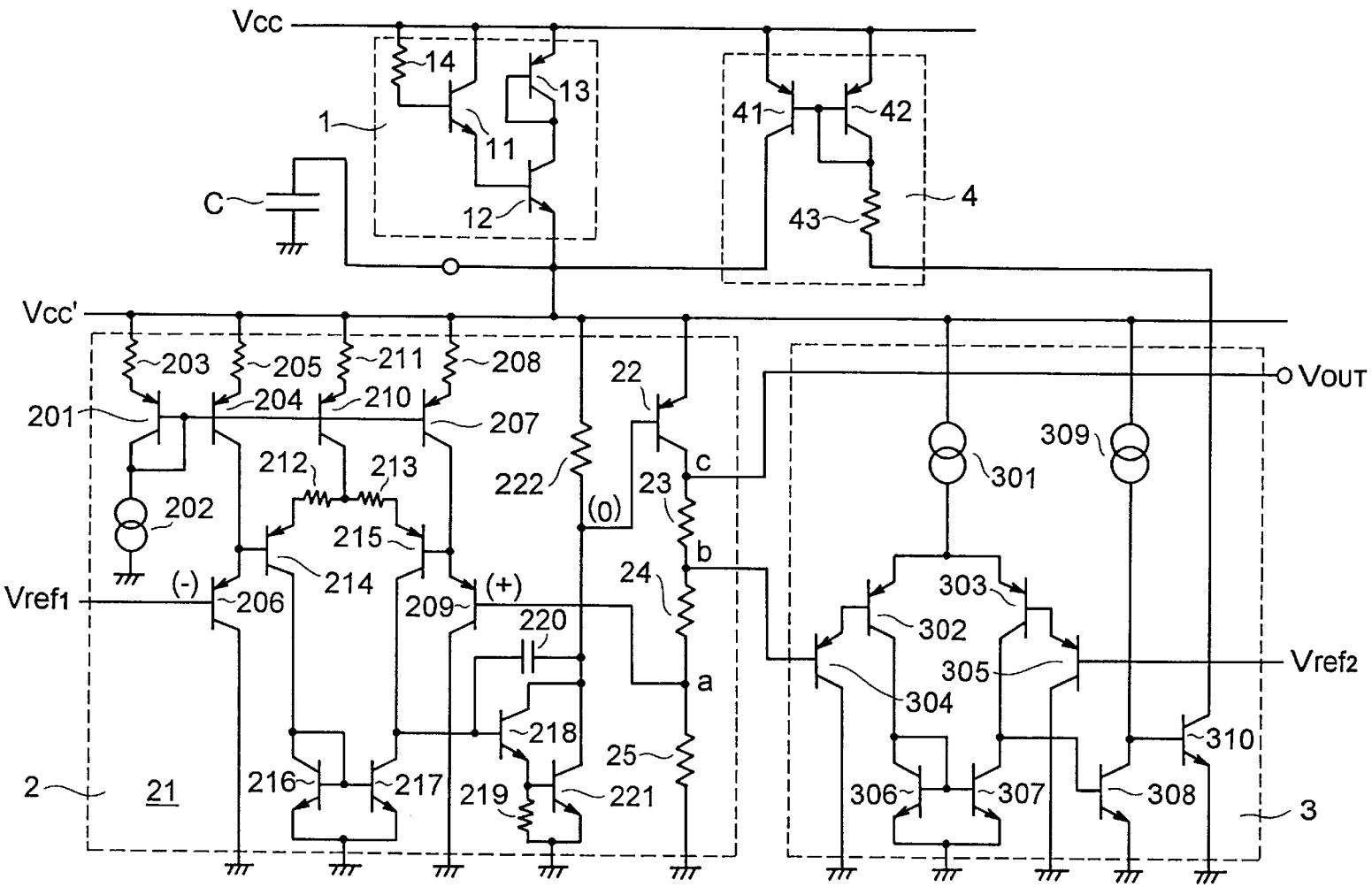
FIG. 2 is a circuit diagram of the power supply device of a second embodiment of the invention.

FIG. 2 shows a circuit diagram of the power supply device of a second embodiment of the invention. Here, such circuit elements as are found also in the first embodiment described previously are identified with the same reference numerals, and their descriptions will not be repeated. The power supply device of this embodiment differs from that of the first embodiment in that the collector of the output-side transistor 41 of the current mirror circuit constituting the switch circuit 4 is connected to the output side of the voltage follower 1 (i.e. to the emitter of the last-stage transistor 12).

Configured as described above, the power supply device of this embodiment operates as described below. When the supply voltage $V_{CC}$ becomes so low that the voltage at the non-inverting input terminal (+) of the operational amplifier 21 of the constant voltage generating circuit 2 becomes lower than the voltage at the inverting input terminal (−) thereof, in other words, when the output voltage $V_{OUT}$ from the constant voltage generating circuit 2 becomes lower than the predetermined level, the transistor 310 of the voltage drop detecting circuit 3 turns from off to on, and thus the transistor 42 of the current mirror circuit constituting the switch circuit 4 turns from off to on. This causes the supply voltage $V_{CC}$ to be supplied through the transistor 41 to the constant voltage generating circuit 2. Thus, here, the output voltage $V_{OUT}$ of the constant voltage generating circuit 2 is equal to $V_{CC}-V_{SAT}$. In this way, it is possible to further reduce the drop that appears in the voltage $V_{OUT}$ output from the constant voltage generating circuit 2 as a result of a drop in the supply voltage $V_{CC}$, though the current capacity obtained here is lower than in the first embodiment.

In the second embodiment described above, the number of transistors that are Darlington-connected in the voltage follower 1 may be one, or three or more. In both of the embodiments described above, the switch circuit 4 may be configured not necessarily as a current mirror circuit but in any other manner as long as it can switch on/off the supply of a current form the supply voltage and it can prevent backflow current. The transistor 41 may be composed of a plurality of stages of Darlington-connected transistors of which the number is smaller than the number of stages of transistors constituting the voltage follower 1. This helps increase the current capacity obtained. The constant voltage generating circuit 2 and the voltage drop detecting circuit 3 may be configured in any other manner than specifically described above.

In summary, by the use of the power supply devices of the embodiments described above, it is possible to reduce the drop in the voltage $V_{CC}'$ supplied to a load as its operating voltage. This helps widen, toward the lower voltage side, the tolerable range of the supply voltage $V_{CC}$ that ensures normal operation of the load. From a different perspective, this eliminates the need to design a load specially to operate normally on a lower minimum operating voltage, and thus permits the use of, for example, a common microcomputer that is reset at a comparatively high voltage. This helps achieve cost reduction.

Figure 3:
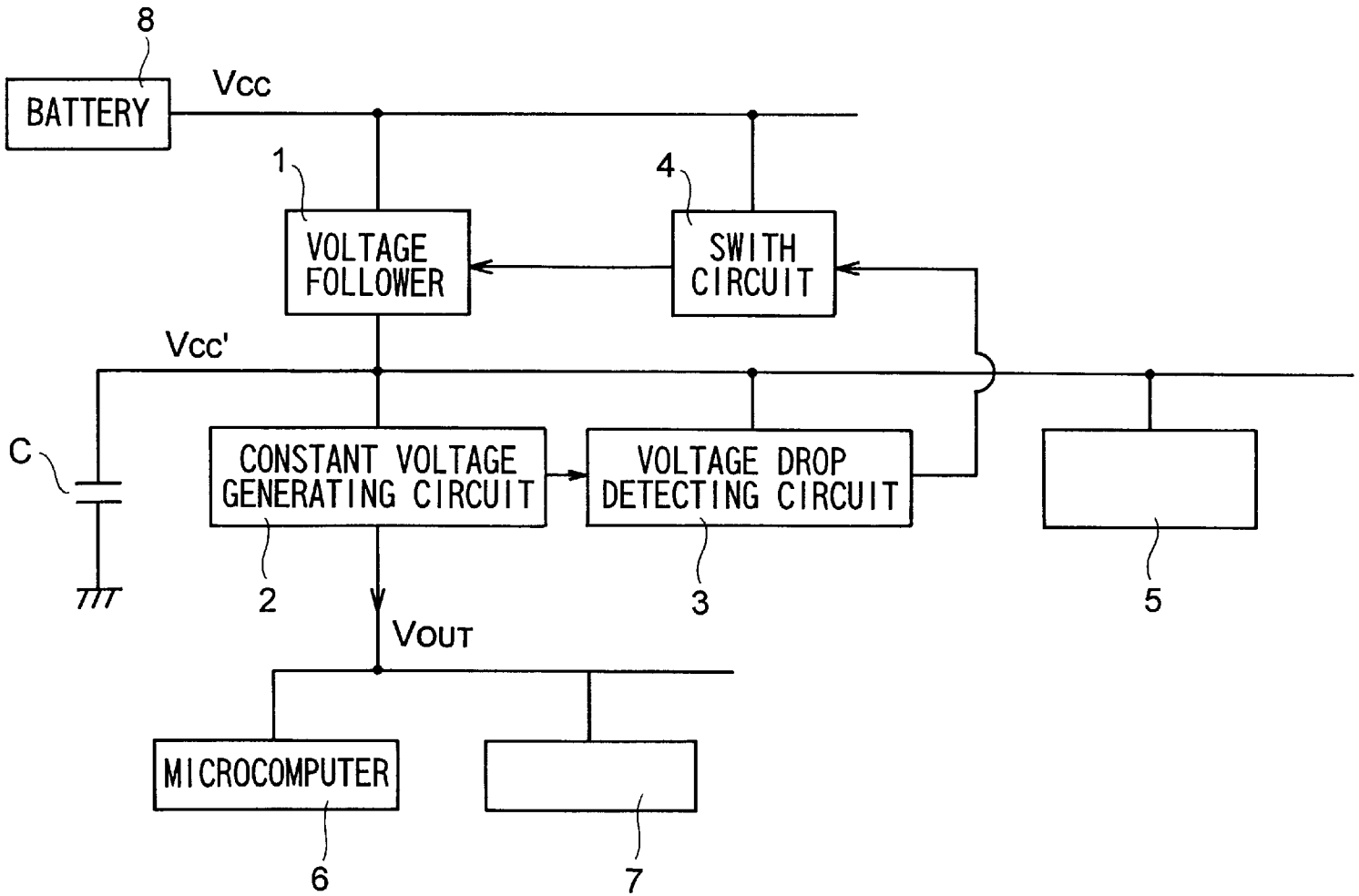
FIG. 3 is a block diagram showing a power supply device embodying the invention together with a battery, load circuits, and other circuits.
Figure 4:
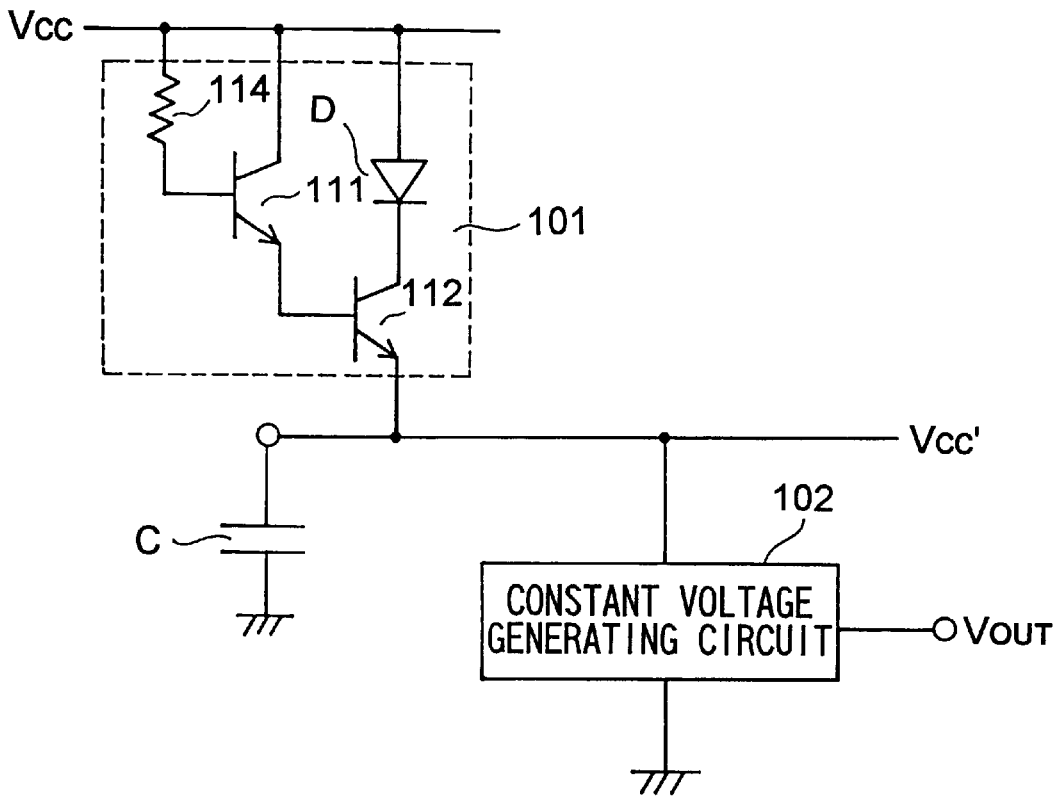
FIG.4 PRIOR ART
FIG. 4 is a circuit diagram of a conventional power supply device.

FIG. 3 is a block diagram showing a power supply device as described above together with a battery, load circuits, and other circuits. In this figure, reference numeral 8 represents a car-mounted battery. Reference numeral 6 represents a microcomputer that operates on the output voltage $V_{OUT}$ of the constant voltage generating circuit 2 and that controls, for example, various functions of audio equipment. Reference numeral 7 represents a circuit, other than a microcomputer, that also operates on the voltage $V_{OUT}$. Reference numeral 5 represents another system that operates on the voltage $V_{CC}'$.

According to the embodiments described above, it is possible to reduce the drop that appears in the voltage output from a power supply device as a result of a drop in a supply voltage, and thus it is possible to widen, toward the lower voltage side, the tolerable range of the supply voltage that ensures normal operation of a load. From a different perspective, this eliminates the need to design a load specially to operate normally on a lower minimum operating voltage, and thus permits the use of, for example, a common microcomputer that is reset at a comparatively high voltage. This helps achieve cost reduction.

What is claimed is:

1. A power supply device comprising:

a voltage follower composed of a plurality of transistors and having one end connected to the supply voltage and another end connected to a capacitor;

a constant voltage generating circuit for producing a constant voltage from a voltage across the capacitor;

a switch circuit connected between the supply voltage and a control electrode of one of the transistors constituting the voltage follower other than a first-stage transistor thereof; and a voltage drop detecting circuit for detecting a drop below a predetermined level in the voltage across the capacitor and turning on the switch circuit on detecting such a drop.

2. A power supply device that produces a predetermined voltage from a supply voltage through a voltage follower composed of a plurality of transistors, comprising:

a switch circuit connected between the supply voltage and a control electrode of one of the transistors constituting the voltage follower other than a first-stage transistor thereof; and a voltage drop detecting circuit for turning on the switch circuit when a level of the supply voltage is lower than a threshold level, wherein the switch circuit is an output-side transistor of a current mirror circuit.

3. A power supply device that produces a predetermined voltage from a supply voltage through a voltage follower composed of a plurality of transistors, comprising:

a switch circuit connected between the supply voltage and a control electrode of one of the transistors constituting the voltage follower other than a first-stage transistor thereof;

a voltage drop detecting circuit for turning on the switch circuit when a level of the supply voltage is lower than a threshold level; and a constant voltage generating circuit that operates on an output voltage from the voltage follower to produce a constant voltage, wherein the threshold level is set equal to a level of the supply voltage at which an output voltage from the constant voltage generating circuit starts falling.

4. A power supply device that produces a predetermined voltage from a supply voltage through a voltage follower composed of a transistor, comprising:

a switch circuit connected between the supply voltage and an output side of the voltage follower; and a voltage drop detecting circuit for turning on the switch circuit when a level of the supply voltage is lower than a threshold level, wherein the switch circuit is an output-side transistor of a current mirror circuit.

5. A power supply device as claimed in claim 4, wherein the voltage follower has a function of preventing backflow current to a battery that supplies the supply voltage.

6. A power supply device comprising:

a voltage follower composed of a transistor and having one end connected to the supply voltage and another end connected to a capacitor;

a constant voltage generating circuit for producing a constant voltage from a voltage across the capacitor;

a switch circuit connected between the supply voltage and an output side of the voltage follower; and a voltage drop detecting circuit for detecting a drop below a predetermined level in the voltage across the capacitor and turning on the switch circuit on detecting such a drop.

* * * * *